US008535178B2

(12) United States Patent
Keller et al.

(10) Patent No.: US 8,535,178 B2
(45) Date of Patent: Sep. 17, 2013

(54) BATTING TEE SYSTEM FOR BAT-AND-BALL GAMES

(76) Inventors: Steve Keller, Seattle, WA (US); Scott Bergevin, Sammamish, WA (US)

( * ) Notice: Subject to any disclaimer, the term of this patent is extended or adjusted under 35 U.S.C. 154(b) by 133 days.

(21) Appl. No.: 12/964,632

(22) Filed: Dec. 9, 2010

(65) Prior Publication Data

US 2011/0136593 A1 Jun. 9, 2011

Related U.S. Application Data

(63) Continuation-in-part of application No. 12/634,546, filed on Dec. 9, 2009.

(51) Int. Cl.
*A63B 69/00* (2006.01)

(52) U.S. Cl.
USPC ..... 473/417; 473/451; 473/422

(58) Field of Classification Search
USPC ..... 473/422, 451, 452, 454, 455, 456, 473/417, 457
See application file for complete search history.

(56) References Cited

U.S. PATENT DOCUMENTS 3,489,411 A * 1/1970 Morelli et al. ..... 473/417
3,883,138 A * 5/1975 Chorey ..... 473/417
4,225,133 A * 9/1980 Kiray ..... 473/457
4,533,138 A * 8/1985 Rodriguez et al. ..... 473/417
4,563,005 A 1/1986 Hand et al.
4,664,374 A * 5/1987 Groves ..... 473/417
4,709,924 A * 12/1987 Wilson et al. ..... 473/417
4,796,885 A * 1/1989 Wright ..... 473/417
4,872,674 A 10/1989 Deal
4,886,267 A 12/1989 Licciardi
4,932,656 A * 6/1990 Pierce ..... 473/452
4,989,866 A * 2/1991 Dill ..... 473/417
4,991,838 A 2/1991 Groves
4,993,708 A * 2/1991 Prossor et al. ..... 473/417
5,076,580 A * 12/1991 Lang ..... 473/417
5,100,134 A * 3/1992 Becker ..... 473/417
5,299,846 A * 4/1994 Rush ..... 473/286
5,320,343 A * 6/1994 McKinney ..... 473/417
5,351,948 A 10/1994 Thomas
5,388,823 A * 2/1995 Prieto ..... 473/417
5,393,050 A * 2/1995 Lloyd ..... 473/429
5,452,896 A 9/1995 Core
5,516,115 A 5/1996 McLain
5,556,091 A * 9/1996 Lin ..... 473/417
5,772,536 A * 6/1998 Wang ..... 473/417
6,612,942 B1 9/2003 Battersby et al.
6,893,363 B1 * 5/2005 Chen et al. ..... 473/417

(Continued)

*Primary Examiner* — Mitra Aryanpour
(74) *Attorney, Agent, or Firm* — Richard C. Vershave; Foster Pepper, PLLC

(57) ABSTRACT

A batting tee system includes a batting tee assembly that may be used with conventional balls or with the ball described as an embodiment of the present invention. Optionally, the batting tee assembly may be used with a netting system or target that provides feedback to a batter based on a trajectory of the ball after it has been struck by a bat and leaves the batting tee assembly. In one embodiment, the batting tee assembly includes a support base coupled to a swing arm, which in turn is coupled to an adjustable-height batting tee. A flexible cup may be coupled to the batting tee to eliminate or substantially reduce the bounce back or recoil felt by a batter when hitting off a batting tee. The batting tee system may be configured for both left and right handed batters and also placed in a portable or storable configuration.

22 Claims, 16 Drawing Sheets

(56) References Cited

U.S. PATENT DOCUMENTS

| | | | | |
|---|---|---|---|---|
| 6,979,273 | B2 | 12/2005 | Tsai | |
| 7,063,632 | B2 | 6/2006 | Green | |
| 7,134,977 | B2 * | 11/2006 | Campbell et al. | 473/454 |
| 7,220,194 | B1 * | 5/2007 | Laiacona et al. | 473/454 |
| 7,255,658 | B1 * | 8/2007 | VanKuiken et al. | 473/454 |
| 7,601,081 | B1 * | 10/2009 | Larkey | 473/454 |
| 7,641,573 | B2 | 1/2010 | Cech | |
| 7,794,339 | B2 * | 9/2010 | Bailey | 473/451 |
| 2002/0072435 | A1 * | 6/2002 | Livingstone | 473/417 |
| 2002/0123397 | A1 | 9/2002 | Brasuell | |
| 2003/0032506 | A1 * | 2/2003 | Chi | 473/417 |
| 2004/0185968 | A1 * | 9/2004 | Livingstone | 473/417 |
| 2005/0255945 | A1 | 11/2005 | Green | |
| 2006/0142099 | A1 * | 6/2006 | Trucks | 473/452 |
| 2007/0082762 | A1 * | 4/2007 | Falgoust | 473/453 |
| 2009/0093325 | A1 * | 4/2009 | Meltzer et al. | 473/454 |
| 2010/0311524 | A1 * | 12/2010 | Lay | 473/417 |
| 2011/0053710 | A1 * | 3/2011 | Hartline | 473/396 |
| 2011/0136592 | A1 * | 6/2011 | Keller | 473/417 |
| 2011/0136593 | A1 * | 6/2011 | Keller et al. | 473/417 |

* cited by examiner

BATTING TEE SYSTEM FOR BAT-AND-BALL GAMES

PRIORITY CLAIM

This application is a continuation-in-part of co-pending, commonly-owned U.S. patent application Ser. No. 12/634,546 filed Dec. 9, 2009 and wherein the subject matter of that application is incorporated herein by reference in its entirety.

FIELD OF THE INVENTION

This invention relates generally to a batting tee system, and specifically relates to a batting tee system to help improve batting stances and hitting mechanics of ball players.

BACKGROUND OF THE INVENTION

"Going with a pitch," a phrase used often in baseball, means knowing where to strike the ball depending on the location of the pitch as it crosses the plate. Advanced players work on this concept regularly, but conventional wisdom considers the concept too complicated for teaching to intermediate or younger players. Generally, intermediate and younger players are taught a proper batting stance and hitting mechanics through repetition using a conventional batting tee, soft toss pitching, full speed pitching (e.g., by a pitcher or pitching machine), or some combination thereof.

SUMMARY OF THE INVENTION

The present invention relates to a batting tee system and methods of using and assembling the same. A batting tee system includes a batting tee assembly that may be used with conventional balls or with the ball described as an embodiment of the present invention. Optionally, the batting tee assembly may be used with a netting system or target that provides feedback to a batter based on a trajectory of the ball after it has been struck by a bat and leaves the batting tee assembly. In one embodiment, the batting tee assembly includes a support base coupled to a swing arm, which in turn is coupled to an adjustable-height batting tee. A flexible cup may be coupled to the batting tee to eliminate or substantially reduce the bounce back or recoil felt by a batter when hitting off a batting tee. The batting tee system may be configured for both left and right handed batters and also placed in a portable or storable configuration.

In accordance with an aspect of the invention, a batting tee system includes a ball carrying at least one target indicator alignable relative to a home base; a batting tee assembly having a base coupled to the home base, the base adjustably coupled to a swing arm that extends laterally over and proximate to an upper surface of the base, the swing arm coupled to an adjustable-height tee selectively positionable along a desired bat-to-ball contact path defined relative to the home base; and a netting system positionable at a desired distance from the batting tee assembly, the netting system having a plurality of indicators arranged to provide feedback information regarding a direction of the ball after it is struck with the bat.

In accordance with another aspect of the invention, a batting tee assembly includes a base portion configured with a home base; a swing arm adjustably coupled to the base, the swing arm extending laterally over and proximate to an upper surface of the base, the swing arm selectively positionable along an arc relative to the home base; and an adjustable-height batting tee coupled to the swing arm, the tee movable with the swing arm to be positioned in a location along the arc corresponding to a type of pitch being simulated.

In accordance with yet another aspect of the invention, a netting system for halting a ball includes a frame assembly; a netting material coupled to the frame assembly; and a plurality of indicators arranged to provide feedback information regarding a direction of the ball after it is struck with a bat.

In accordance with another aspect of the invention, a method of setting up a batting tee system includes the steps of (1) arranging a home base for a left or right handed batter, the home base coupled to a base portion of the batting tee system; (2) coupling a first end portion of a swing arm to the base portion; (3) rotating a second end portion of the swing arm about a pivot located relative to the home base, the second end portion distally located from the first end portion; and (4) setting an adjustable-height batting tee at a desired position along a contact path to simulate a desired pitch.

In accordance with yet another aspect of the invention, a cup for a batting tee system includes a ball support portion; an engagement portion receivable by a tubular member of the batting tee system; and a flexible portion located between the ball support portion and the engagement portion, wherein the flexible portion is predisposed to bend before the ball support portion bends when a ball is hit off the batting tee.

In accordance with still yet another aspect of the invention, a batting tee assembly includes a base portion configured with a home base; a swing arm adjustably coupled to the base, the swing arm extending laterally over and proximate to an upper surface of the base, the swing arm selectively positionable along an arc relative to the home base; an adjustable-height batting tee coupled to the swing arm, the tee movable with the swing arm to be positioned in a location along the arc corresponding to a type of pitch being simulated; and a cup having a ball support portion, an engagement portion, and a flexible portion, the engagement portion removably engageable with the batting tee, the flexible portion predisposed to bend before the ball support portion bends when a ball is hit off the batting tee.

In still yet another aspect of the invention, a method of setting up a batting tee system includes the steps of (1) arranging a home base for a left or right handed batter, the home base coupled to a base portion of the batting tee system; (2) coupling a first end portion of a swing arm to the base portion; (3) rotating a second end portion of the swing arm about a pivot located relative to the home base, the second end portion distally located from the first end portion; (4) setting an adjustable-height batting tee at a desired position along a contact path to simulate a desired pitch; and (5) attaching a flexible cup to the batting tee by inserting a portion of the cup and rotating it relative to the tee such as to lock the cup relative to the tee, wherein the flexible portion is predisposed to bend before the ball support portion bends when a ball is hit off the batting tee.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
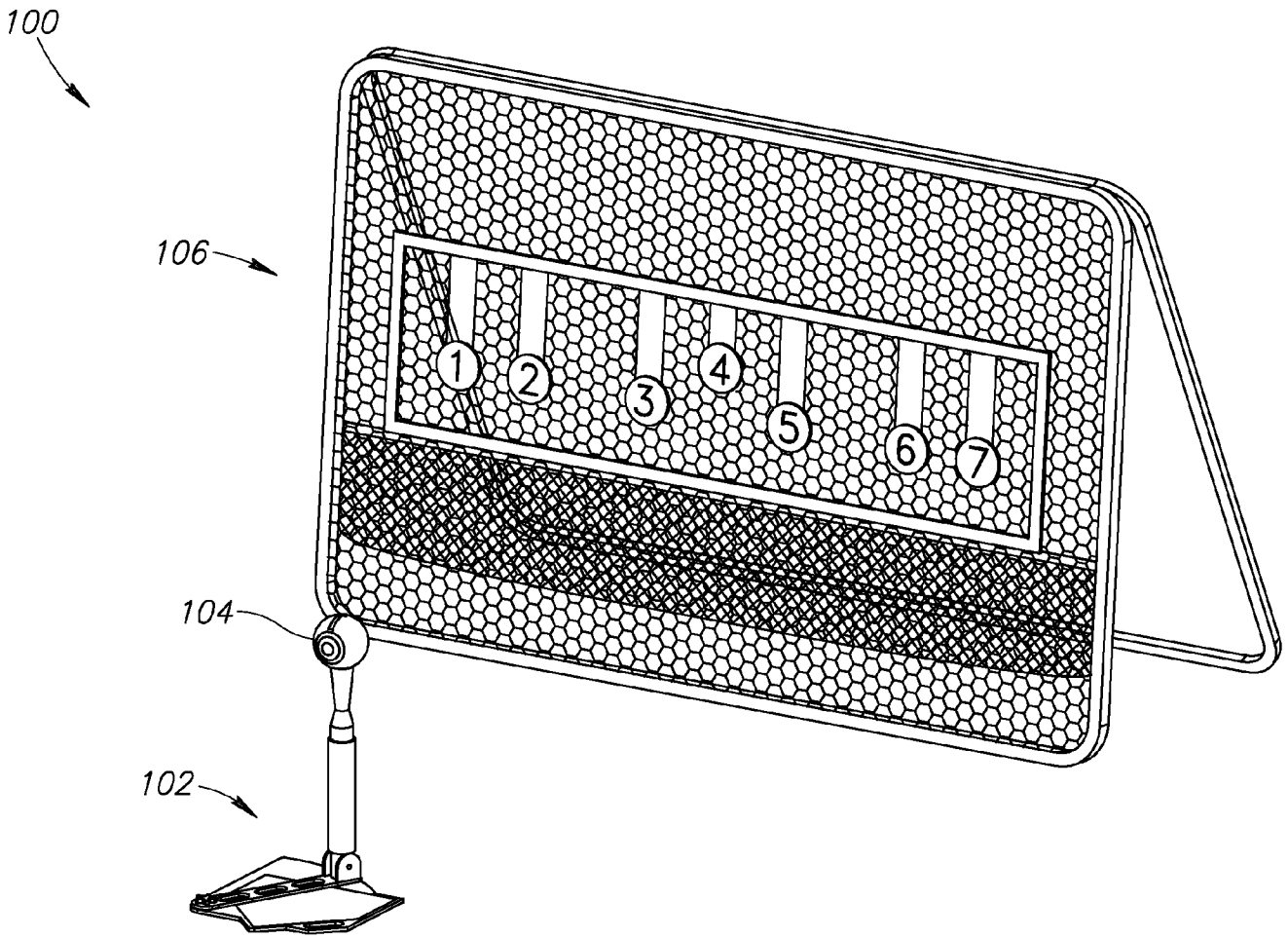
FIG. 1 is a batting tee system having a batting tee assembly, a ball and a netting system according to an embodiment of the present invention.

In the following description, certain specific details are set forth in order to provide a thorough understanding of various embodiments of the invention. However, one skilled in the art will understand that the invention may be practiced without these details. In other instances, well-known structures associated with bat and ball systems, hitting systems, catching systems and the assembly and operation thereof have not necessarily been shown or described in detail to avoid unnecessarily obscuring descriptions of the embodiments of the invention. At least one embodiment of the invention includes a batting tee system that allows and encourages players to work on proper bat-to-ball contact for a variety of pitches.

Unless the context requires otherwise, throughout the specification and claims which follow, the word "comprise" and variations thereof, such as, "comprises" and "comprising" are to be construed in an open, inclusive sense.

In addition, throughout the specification and claims which follow, any reference to a bat-and-ball game may include, but is not limited to, games such as baseball, softball, stickball, rounders, pesäpallo, Finnish baseball, and British baseball. Bat-and-ball games are generally played when one team (the fielding team) has possession of the ball and delivers it to a member of the other team (the batting team), who tries to hit it. The two opposing teams take turns playing these two distinct roles, which are continuous during a specified interval, commonly referred to as an inning. For purposes of the present description, the word "ball" should be broadly interpreted to relate to any ball used in a bat-and-ball activity. Some examples of such balls include, but are not limited to, regulation and non-regulation baseballs and softballs, cricket balls, tennis balls, etc. Similarly, the term "bat" may be interpreted to broadly include, but not be limited to, regulation and non-regulation baseball bats, softball bats, wooden bats, metal bats, cricket bats, etc. Lastly, the phrase "home base" should be interpreted as any plate, symbolic reference, design, or other device used to provide a visual reference for a batter. The term "home base" may be use synonymously with the term "home plate" herein. Further, the term "base" used without the adjective "home" should be broadly interpreted to be a structural support platform for the batting tee system into which the home plate may be recessed.

For purposes of the present description to maintain brevity and consistency, the various embodiments of the invention will be described relative to the bat-and-ball game of baseball. Baseball players may learn by a fairly young age that the proper place to make contact with a baseball depends on where it crosses home plate. Many batting instructors teach that an inside pitch should be met by the bat well in front of home plate while contact with an outside pitch should be further back relative to the plate. Advanced hitters, those who have played baseball for many years, are taught how and where to make proper contact as the ball crosses home plate through such activities as live batting practice or soft toss. Because players of all ages are encouraged to practice their swing using a batting tee, the batting tee system described herein permits this type of general batting practice while providing numerous advantages for simulating different types of pitches (e.g., high and inside, low and outside, etc.) and where contact should be made when the ball crosses home plate.

Figure 2:
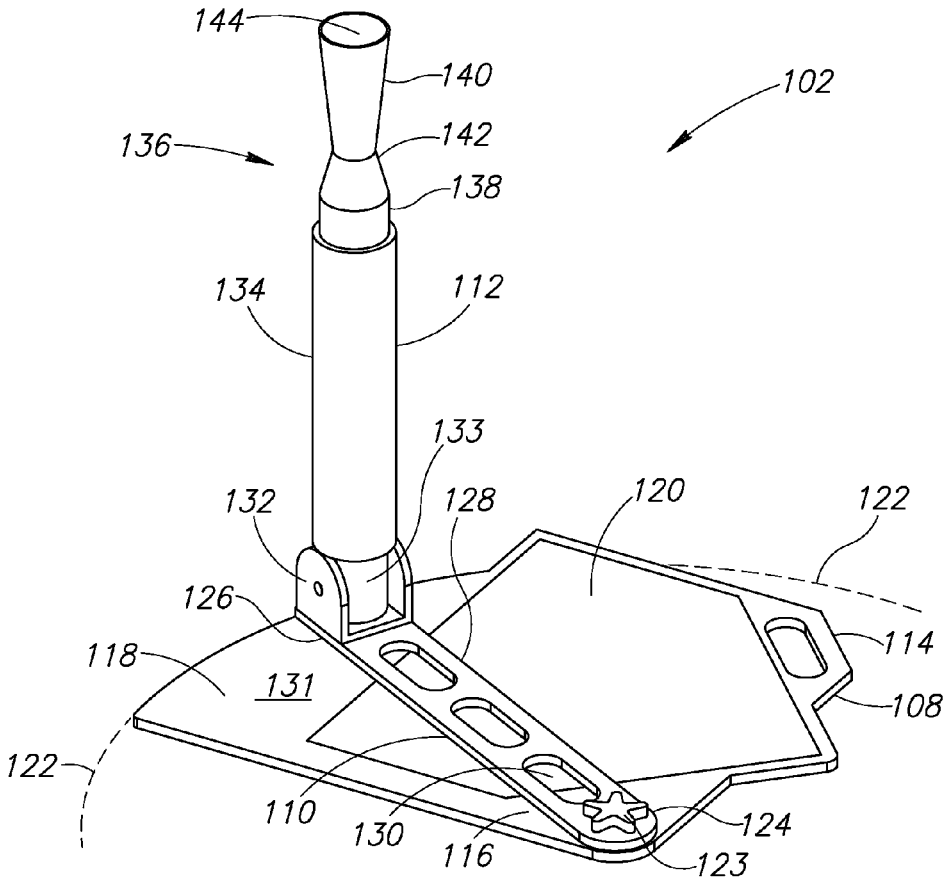
FIG. 2 is perspective view of the batting tee assembly of FIG. 1 with a batting tee in an operable position.

FIG. 1 shows a batting tee system 100 having a batting assembly 102 and a ball 104, which may take the form of a marked ball described with reference to FIG. 9. The batting tee system 100 may optionally include a netting system 106 for stopping the ball 104 after contact by a bat (not shown). The batting tee system 100 may be made or adjusted to various sizes and may be used indoors or outdoors. The batting tee system 100 permits the ball to be set at a desired contact point relative to the home plate 120R (FIG. 2). In turn, this builds strong home plate reference awareness and hitting mechanics for beginning to advanced batters. The batting tee assembly 102 is easily adjustable and keeps the ball 104 in a level position, which in turn permits batters to work on a variety of ball contact points, such as inside, outside, high and low.

Components of the batting tee system 100 may be made from plastic, metal, rubber or reinforced composites. Further, the batting tee system 100 is portable and storable because it includes features that permit it to be folded into a compact or portable configuration. The batting tee assembly 102 is also convertible for use by both left-handed and right-handed batters, which will be explained in greater detail below.

FIG. 2 shows the batting tee assembly 102 in an upright or operational configuration and also in a right-handed batting configuration. The batting tee assembly 102 includes a support base 108 coupled to a swing arm 110, which in turn is coupled to a batting tee 112. The support base 108 may be configured to substantially prevent tipping or undesired rocking of the batting assembly 102 when in use, for example when the bat strikes the batting tee 112. In the illustrated embodiment, the support base 108 includes a handle 114, a swing arm attachment region 116, a contact path region 118 and a home base region 120R, where the "R" refers to the support base 108 being in the right-handed batting configuration. In one embodiment, the support base 108 is made from a durable rubber material, such as a natural rubber material, and selectively weighted to prevent tipping or rocking. The home base region 120, as illustrated, takes the familiar form of a home plate in baseball, but may take other shapes as well. The home base region 120 may take the form of an insert bonded into a recessed portion of the support base 108, may take the form of an adhesive-backed, home-plate-shaped sticker bonded onto the support base 108, or may be painted or otherwise printed onto the support base 108.

In the illustrated embodiment, the contact path region 118 includes a periphery that defines a contact path 122, which in turn is defined by a sweeping or rotational motion of the swing arm 110 about a pivot point 123, which is located on the swing arm attachment region 116.

Figure 11:
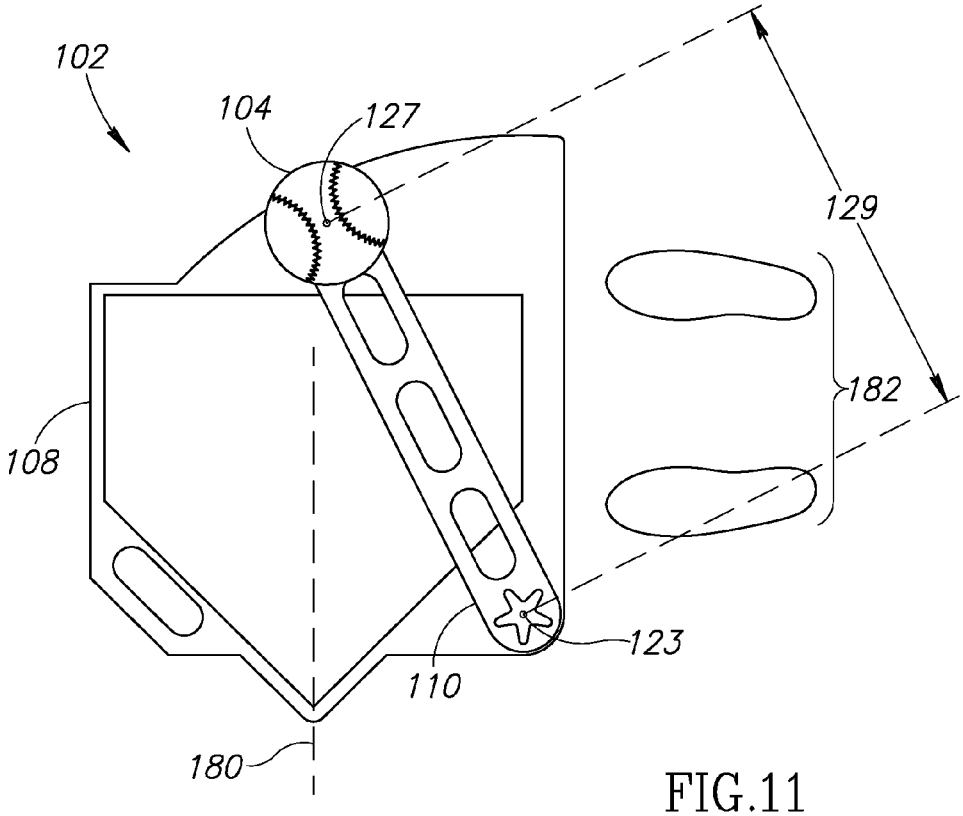
FIG. 11 is a top plan view of the batting tee assembly and ball of FIG. 1 showing an exemplary setting thereof for one type of simulated pitch.

The swing arm 110 includes a first end portion 124 rotational coupled to the support base 108 through the pivot point 123. The swing arm 110 further includes a second end portion 126 distally located from the first end portion 124 with a body 128 extending therebetween. The body 128 may include holes or openings 130 to reduce the overall weight of the swing arm 110. The swing arm 110 extends laterally over and proximate to an upper surface 131 of the support base 108. As best shown in FIG. 11, an effective length 129 of the swing arm 110, which is measured from the pivot point 123 to a cylindrical axis point 127 of the batting tee 112, defines the contact path 122. The operation of the swing arm 110 along the contact path 122 in conjunction with the positioning of the batting tee 112 relative to the home base 120 is discussed in greater detail below.

Still referring to FIG. 2, an attachment member 132 for coupling the swing arm 110 to the batting tee 112 may take the form of a boss, a lug or some other structural member. The attachment member 132 may be integrally formed with the swing arm 110 or a separate component. An extender 133 configured to receive the batting tee 112 may be connected to the attachment member 132. These connections are described in greater detail below with respect to FIG. 5.

In the illustrated embodiment, the batting tee 112 takes the form of a telescoping batting tee having a lower segment 134 that telescopically and slidably receives an upper segment 136. The upper segment 136 includes a lower portion 138 configured to slide into the lower segment 134, an upper portion 140 configured to support the ball, a necked down portion to provide flexibility when the upper portion 140 is struck with a bat (not shown), and a cup or funnel shaped portion 144 configured to receive and support the ball. The batting tee 112 may be made from a durable rubber material, such as a natural rubber material and its thickness may be sufficient to withstand repeated impact strikes from the bat (not shown).

Figure 3:
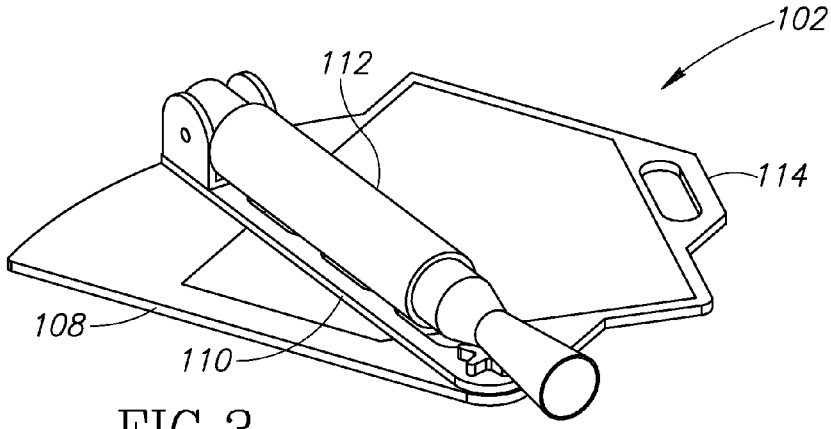
FIG. 3 is perspective view of the batting tee assembly of FIG. 1 with a batting tee in a stored or portable position.

FIG. 3 shows the batting tee assembly 102 in a stored or portable configuration. The batting tee 112 is folded down onto the swing arm 110 and these components may be located at any desired orientation relative to the support base 108. The handle 114 may be used to carry or otherwise move the batting tee assembly 102.

Figure 4:
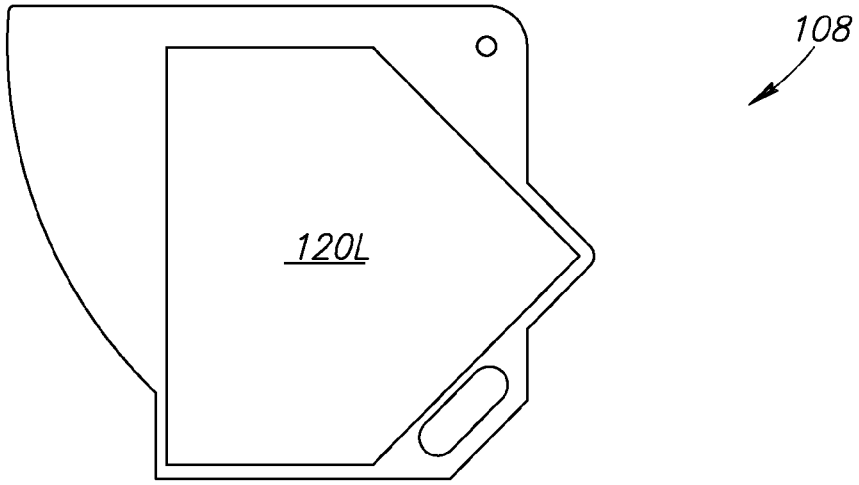
FIG. 4 is bottom plan view of a support base for the batting tee assembly of FIG. 1 with a home base configured for a left-handed batter.

FIG. 4 shows the support base 108 in a left-handed batting configuration, which may be achieved by simply flipping the support base 108 over. In other words, the home base 120L is provided on mirror surfaces (i.e., top and bottom surfaces) of the support base 108. The "L" refers to the support base 108 being in the left-handed batting configuration.

Figure 5:
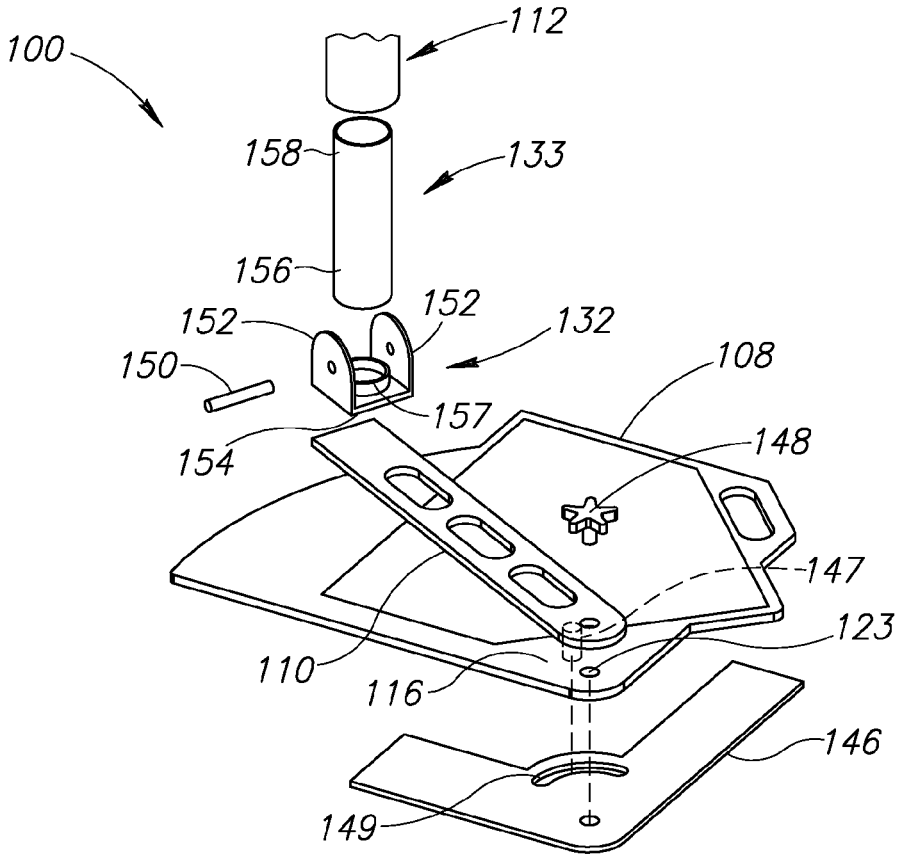
FIG. 5 is an exploded, perspective view of a batting tee assembly according to an embodiment of the present invention.

FIG. 5 shows an exploded view of the batting tee system 100 having the support base 108, the swing arm 110 and the batting tee 112. The support base 108 may include one or more reinforcement members 146, which may be configured with a desired shape, thickness and structural properties. In the illustrated embodiment, the reinforcement member 146 takes the form of a corner reinforcement member 146 that may be coupled to the swing arm attachment region 116. If the support base 108 is switched from a right-handed to a left-handed batting configuration, or vice versa, the reinforcement member 146 may be switched as well. In one embodiment, the reinforcement member 146 may be imbedded or overmolded into the support base 108 such that it remains permanently in place and may not be visible when looking downward at the base 108. A fastening device 148 may be used to attach the swing arm 110, the support base 108 and the corner reinforcement 146 together. In the hole forming the pivot point 123, it is appreciated that a sleeve or liner (not shown) may be inserted to provide bearing protection for the support base 108. In addition, the sleeve or liner may include internal threads for engaging the fastener 148. In one embodiment, a range-of-motion limiter 147 may extend from the swing arm 110 and be received by a slot 149 formed in the reinforcement member 146. Accordingly, the slot 149 may have a configuration, such as a desired curvature to limit or otherwise prevent the swing arm 110 from rotating beyond a desired amount relative to the support base 108.

The batting tee 112 may be pin-connected with the swing arm 110 by way of the attachment member 132, the extender 133 and a pin 150. The attachment member 132 may take the form of a fitting having ears 152 coupled to a base member 154, which in turn may be mechanically attached (e.g., bonded, fastened, welded, etc.) to the swing arm 110. The extender 133, likewise, may take the form of cylindrical member having a first end portion 156 distally located from a second end portion 158. The first end portion 156 is sized to frictionally engage or threadably couple with a complementary-shaped boss 157 extending from the base member 154 while the second end portion 158 is sized to be telescopically received by the batting tee 112. The fit between the aforementioned components may be sufficiently snug to frictionally prevent undesired rotation. The pin 150 operates to provide the pin-connection, thus permitting the batting tee 112 to be moved between the operational and portable configurations. When the batting tee system 100 is in the operational configuration, the pin 150 may be retained or otherwise held in place by conventional means, such as with a cotter pin (not shown).

Figure 6:
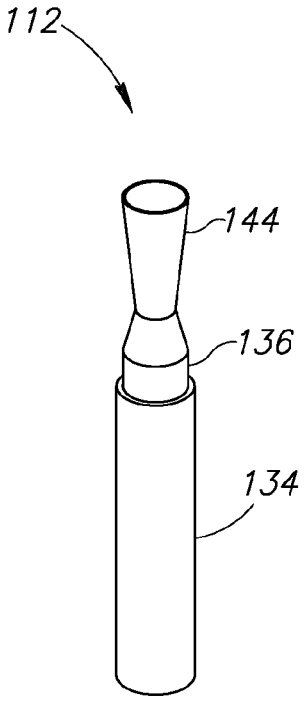
FIG. 6 is a side elevational view of a batting tee adjusted to a minimum height according to an embodiment of the present invention.

FIGS. 6-9 show how the batting tee 112 may be adjusted to different heights. In FIG. 6, the batting tee 112 is shown at its minimum height. To achieve the minimum height, the upper segment 136 is telescopically moved into the lower segment 134 until a minimum height of the batting tee 112 is about twenty inches as measured from the support base 108 (FIG. 2) to an upper edge of the cup-shaped portion 144.

Figure 7:
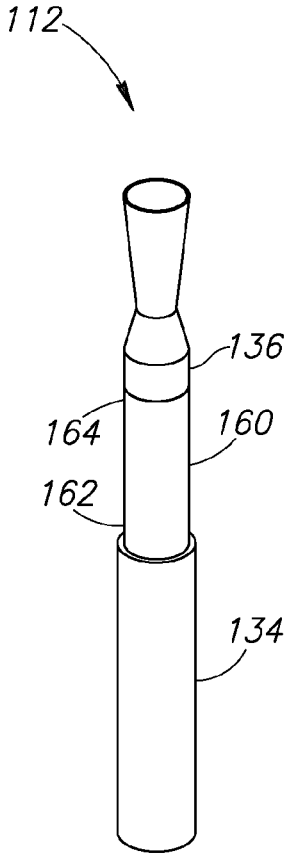
FIG. 7 is a side elevational view of a batting tee adjusted to a mid-range height according to an embodiment of the present invention.

In FIG. 7, the batting tee 112 is shown at a mid-range height that may be achieved by using an intermediate member 160 having a lower portion 162 configured to be received by the lower segment 134 and an upper portion 164 configured to receive the upper segment 136.

Figure 8:
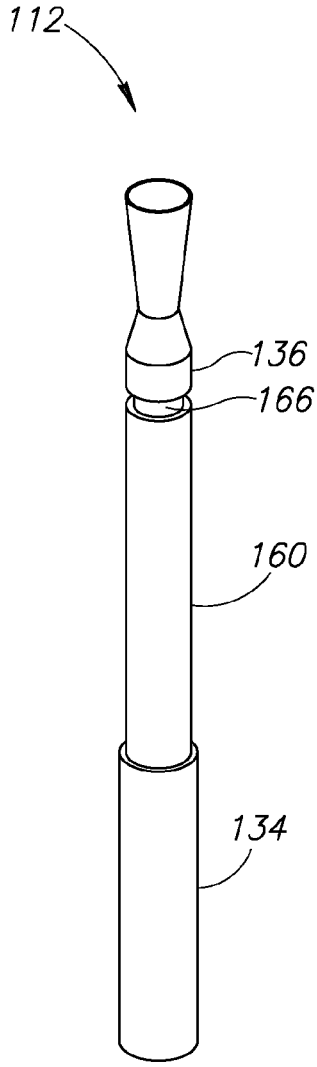
FIG. 8 is a side elevational view of a batting tee adjusted to a maximum height according to an embodiment of the present invention.

FIG. 8 shows the batting tee 112 at a maximum height by having the intermediate member 160 fully, telescopically extended and also having the upper segment 136 fully, telescopically extended. In the illustrated embodiment, the upper segment 136 includes a coupling portion 166 that is received by the intermediate member 160. When the batting tee 112 includes the intermediate member 160, the height of the batting tee 112 may be adjusted between about sixteen inches to about over fifty inches according to an embodiment of the invention. If the intermediate member 160 is not included, the height of the batting tee may be adjusted between about sixteen inches to about over thirty inches. In one embodiment, the batting tee 112 may not include an intermediate member, but still be adjustable to have a height over fifty inches. Nevertheless, it is appreciated that these defined adjustment heights are merely provided as examples and are not meant to limit the scope of the invention.

Figure 9:
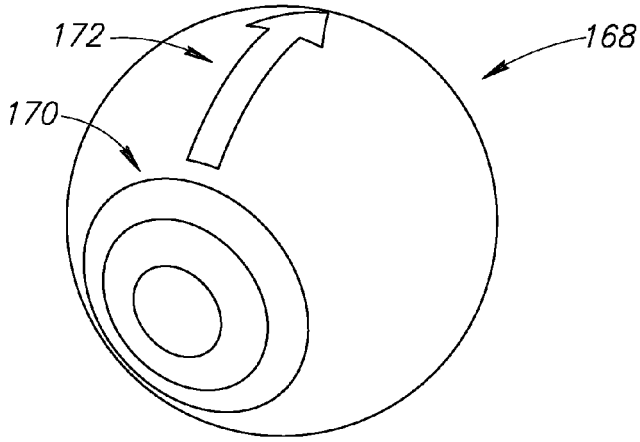
FIG. 9 is a perspective view of the ball used in the batting tee system of FIG. 1 according to an embodiment of the present invention.

FIG. 9 shows a ball 168 having a target indicia or marking 170 and a directional indicia or marking 172. The target indicia 170 may take the form of a bulls-eye marking to indicate where the batter should make contact with the bat when swinging. The directional indicia 172 may take the form of an arrow aligned with the target indicia 170. The direction of the arrow indicates to the batter the general direction the ball should travel after being struck with the bat. The ball 168 may be made from a medium-density foam, rubber or other material that would provide sufficient weight and robustness while not allowing it to hurt property or persons if hit in an undesired direction or in an undesired manner.

Figure 10:
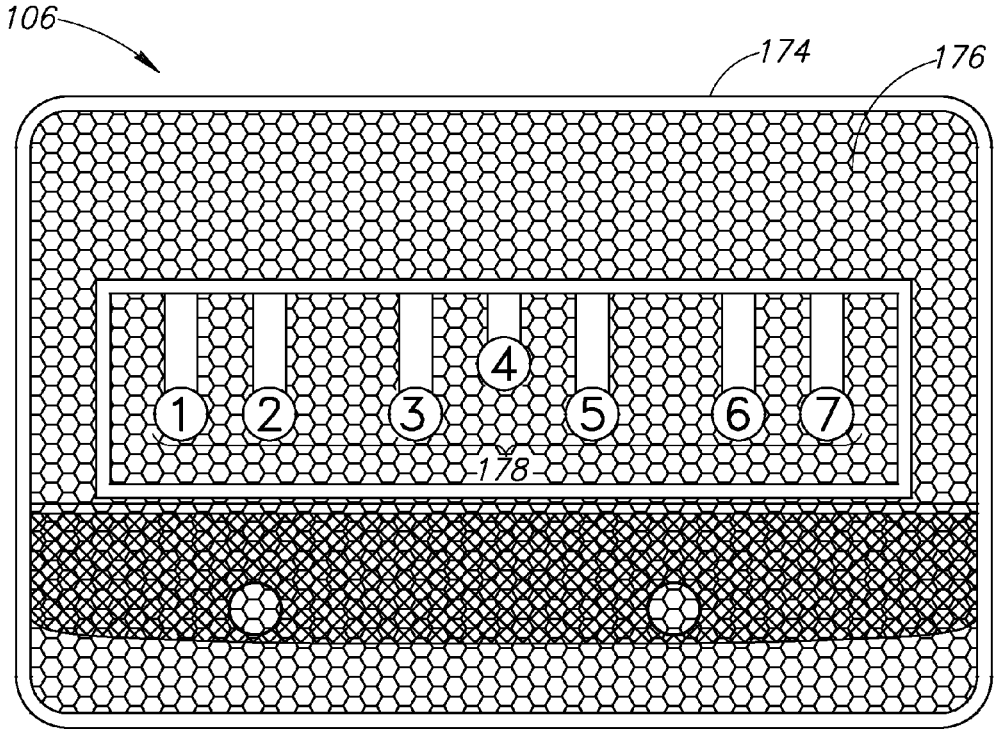
FIG. 10 is a front elevational view of the netting system of FIG. 1.

FIG. 10 shows the netting system 106 having a frame assembly 174, a netting material 176 coupled to the frame assembly 174, and a plurality of indicators 178 arranged to provide feedback information to a batter regarding a direction of the ball 168 (FIG. 9) after it has been struck with the bat (not shown). In the illustrated embodiment, the indicators 178 may take the form of numbered and/or colored targets or signs attached to the netting material 176; however other than alphanumeric symbols may be used. The indicators 178 provide an aiming point for the batter where the object is to strike the ball 168 (FIG. 9) from the batting tee 112 such that the ball 168 hits or comes sufficiently close to a desired indicator 178. For example, a right-handed batter hitting an inside pitch would aim for the first two indicators on the left side of the netting system 106. Alternatively, a right-handed batter hitting an outside pitch would aim for the last two indicators on the right side of the netting system 106. In addition to the indicators 178 being arranged in a left-to-right perspective relative to the frame assembly 174, a height of the indicators 178 may also be selected to indicate that the batter hit the ball in a level manner. The number or indicators 178 and their location relative to the frame assembly 174 may be modified depending on an objective of the batter, a coach or a parent, for example. In the illustrated embodiment, there is not any netting material located behind the indicators 178, but it is appreciated that the same or a lighter-duty netting material may be arranged behind the indicators 178 to prevent the ball from traveling too far. In one embodiment, the frame assembly 174 is made from aluminum, the netting material 176 is made from a polyethylene material, and the indicators 178 are made from a heavy duty nylon material.

Figure 12:
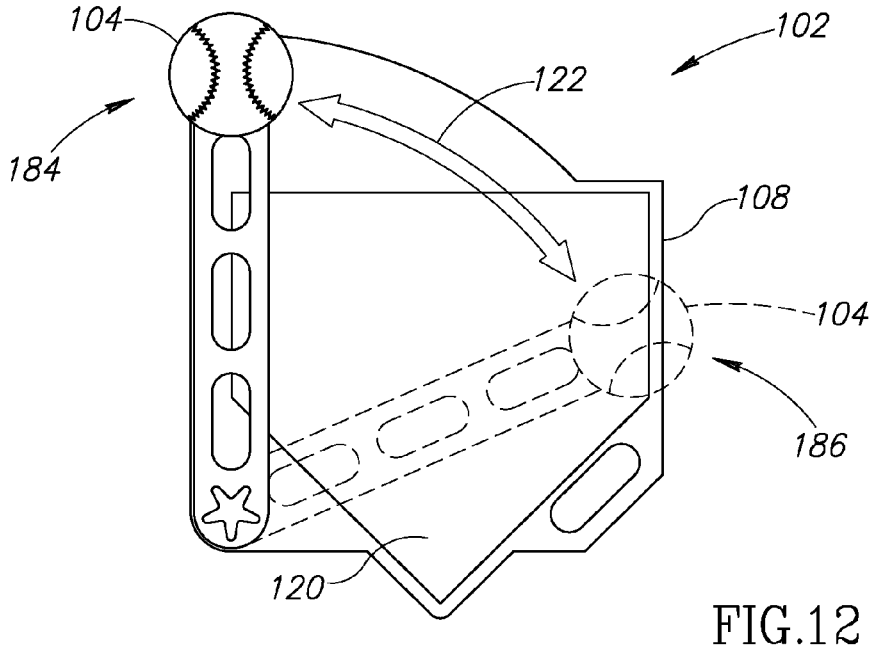
FIG. 12 is a top plan view of the batting tee assembly and ball of FIG. 1 showing other exemplary settings thereof for inside and outside simulated pitches.
Figure 13:
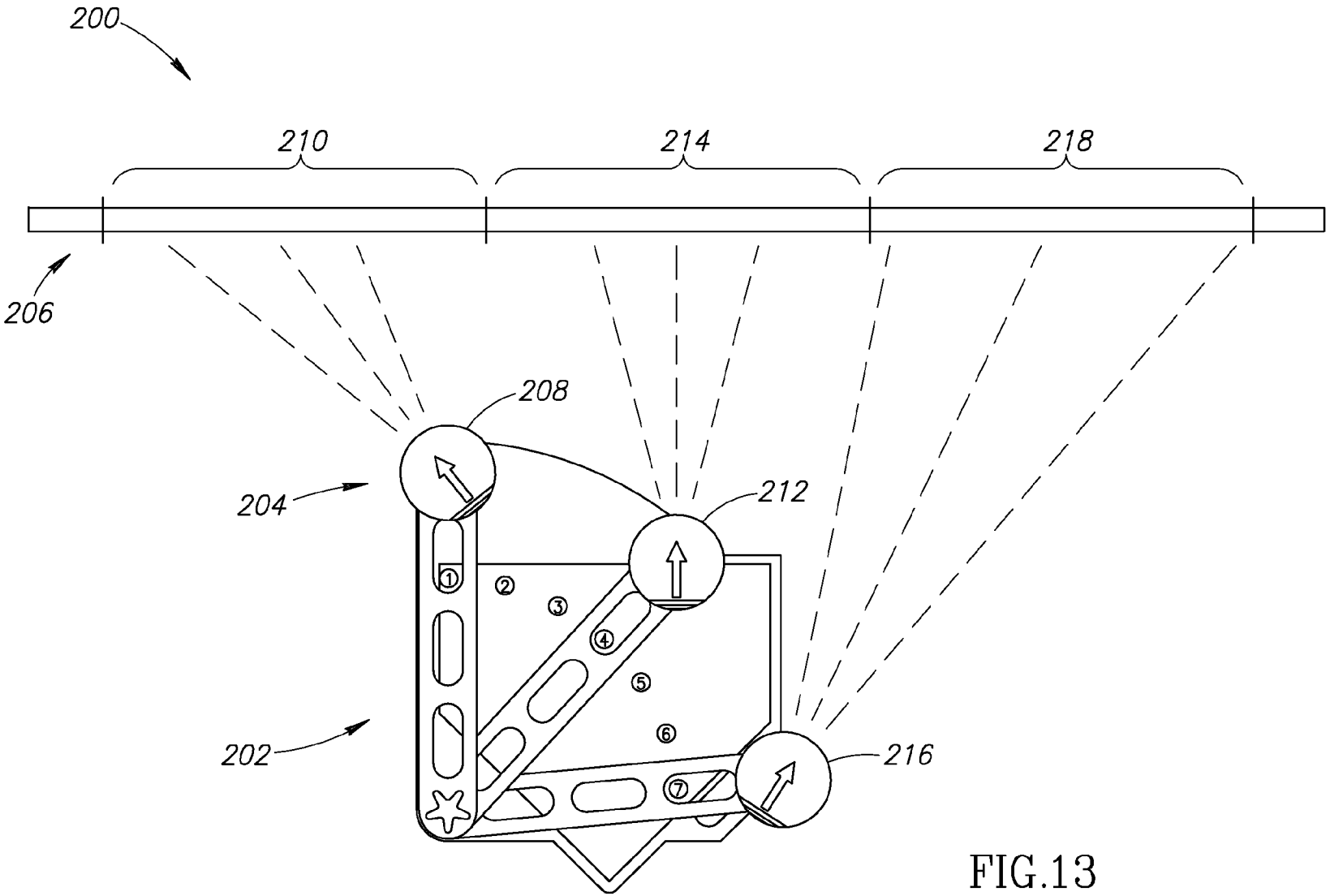
FIG. 13 is a schematic view of a batting tee system showing an overall operation thereof according to an embodiment of the present invention.

FIGS. 11-13 are provided to describe the operation of the batting tee system, and more specifically to describe how the batting tee system may be utilized to help a batter properly hit different types of pitches. FIG. 11 shows the swing arm 110 positioned to simulate a fast ball pitch where the ball 168 crosses the home plate 120 approximately in a straight line over a symmetrical centerline 180 of the home plate 120. For a left-handed batter, the swing arm 110 is secured to a far side of the support base 108 relative to the batter's stance as indicated by the footprints 182.

FIG. 12 shows the movement of the swing arm 110 along the contact path 122 with the batting tee assembly 102 set up with a ball 104 for a right-handed batter. The swing arm 110 may be rotatable relative to the support base 108 about the pivot point 123 such that the ball 104 may be positioned anywhere along the contact path 122 with incremental changes, as desired. In one embodiment, the swing arm 110 is movable through a circular, 360 degree, contact path 122. Further, the positioning of the swing arm 110 relative to the home base 120 permits the batter to learn how to hit the ball 104 at a proper time as it crosses the home base 120. By way of example, the batting tee assembly 102 teaches the right-handed batter to hit an inside pitch 184 just before the ball 104 moves across a front part of the home base 120. Similarly, the batting tee assembly 102 teaches the right-handed batter to hit an outside pitch 186 after the ball 104 has already moved across the front part of the home base 120. Thus, if the batter is not making proper contact with the ball 104, the batter will learn to adjust his or her stance relative to the home base 120. In addition, the batting tee assembly 102 may help the batter to adjust the speed and levelness of his or her bat swing.

FIG. 13 schematically illustrates a batting tee system 200 having a batting tee assembly 202, a ball 204 and a feedback system 206, where the latter may take the form of a netting system as described above. The batting tee system 200 attempts to replicate a live batting situation as it teaches and reinforces various hitting mechanics, such as, but not limited to, the batter's stance relative to home plate, arm extension for various types of pitches, recognition of various types of pitches, the bat-on-ball contact location relative to the home plate, bat speed, bat position, etc. For young batters in particular, the batting tee system 200 may be easily set up and adjusted to simulate a variety of pitches while providing immediate feedback based on the trajectory of the ball. By way of example and as shown in FIG. 13, the batting tee system 200 may help the right-handed batter learn the mechanics of how to hit an inside pitch 208 toward a left section 210 of the feedback system 206, how to hit a straight pitch 212 toward a center section 214 of the feedback system 106, and how to hit an outside pitch 216 toward a right section 218 of the feedback system.

Figure 14:
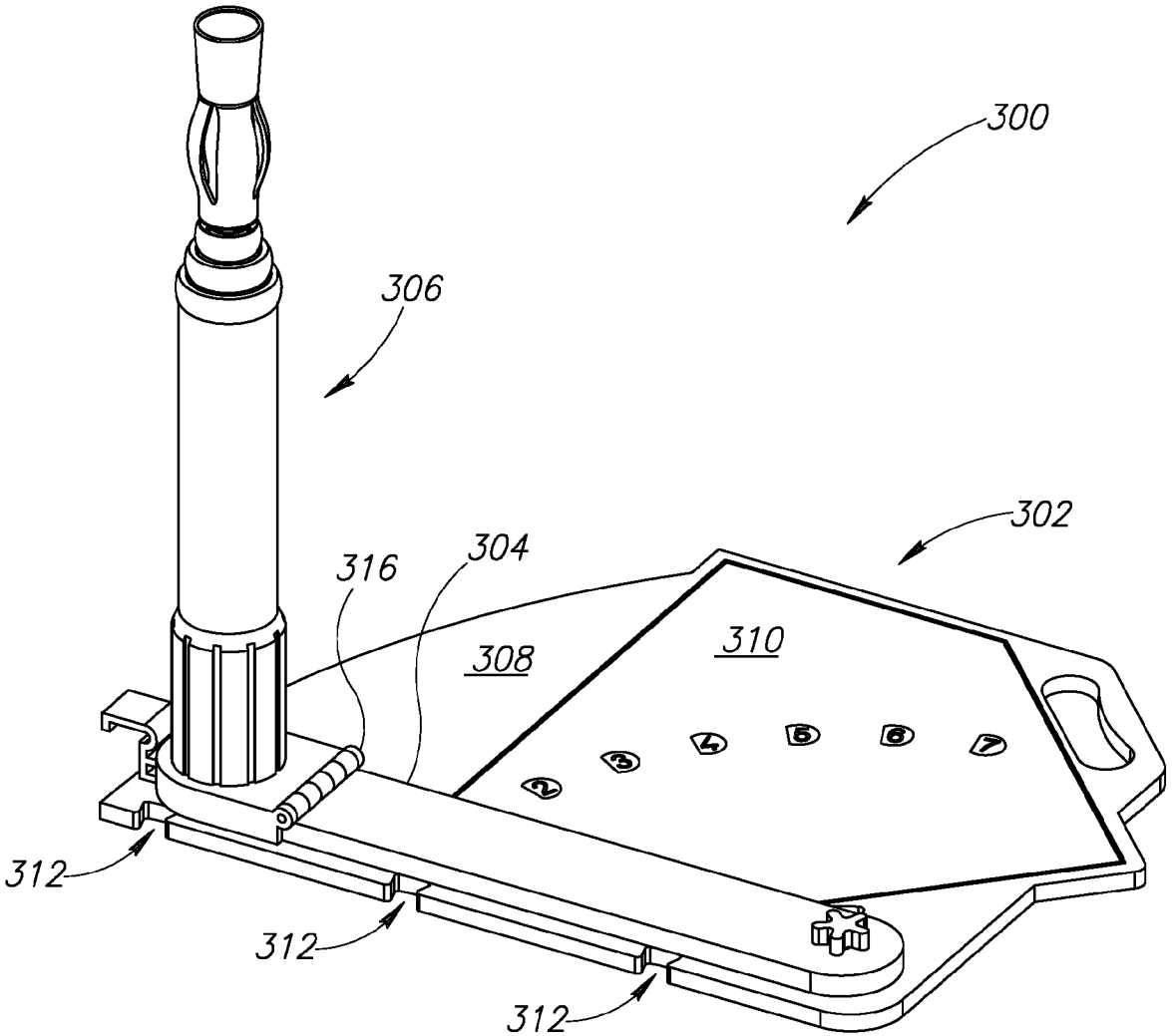
FIG. 14 is a perspective view of a batting tee system according to another embodiment of the present invention.
Figure 15:
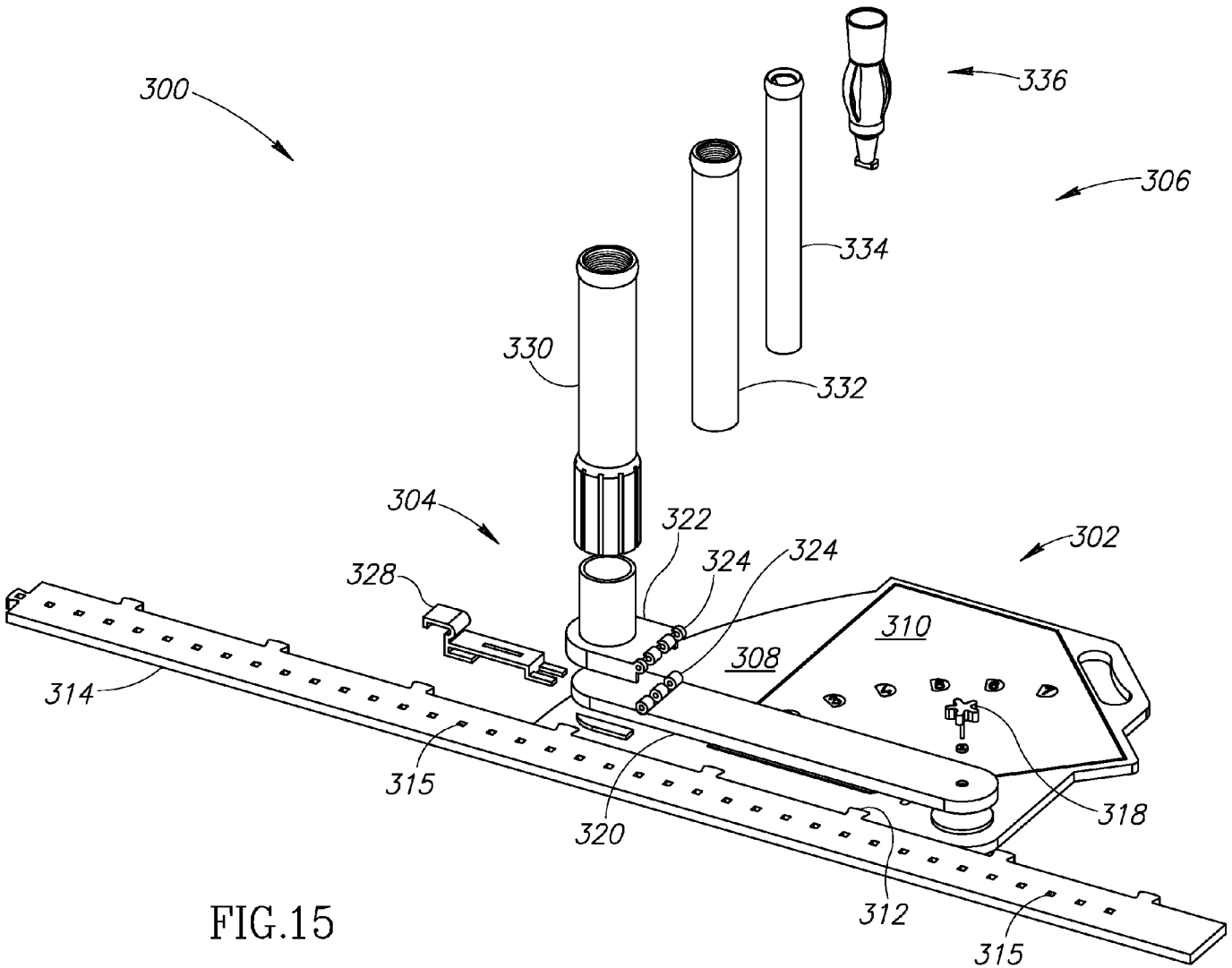
FIG. 15 is an exploded, perspective view of the batting tee system of FIG. 14.

FIG. 14 shows a batting tee system 300 according to another embodiment of the present invention. The batting tee system 300 includes a platform 302, a swing arm 304 and a tee 306. Aspects of the batting tee system 300 that are similar to or structurally consistent with the system described above will not be discussed in detail for purposes of brevity. In one embodiment, the platform 302 includes a support portion 308 having a recess to receive a plate 310. In another embodiment, the plate 310 may be painted, stenciled or otherwise graphically framed onto the platform 302. Preferably, the plate 310 is flush with the support portion 308. In the illustrated embodiment, the support portion 308 includes engagement features 312 for connecting to a stance guide 314 (FIG. 15). The engagement features 312 may take a variety of forms, such as the tapered female notches shown in FIG. 14.

FIG. 15 shows an exploded view of the batting tee system 300 except that the stance guide 314 is coupled to the support portion 308. The stance guide 314 may take the form of a strip with visible indications 315 that remind or instruct the batter how to position their feet relative to home plate 310. By way of example, some players unwittingly adjust their stance forward or backward even when a certain pitch or pitching style does not warrant such adjustment. Thus, the stance guide 314 permits batters to recognize slight forward or backward adjustments that could adversely affect how they may ultimately hit the ball. The swing arm 304 includes a lockdown knob 318, an arm member 320, and a tee support member 322, which is hinged to the arm member 320 with a hinge 324. In addition, the hinge 324 may be locked or unlocked with a movable clip 328.

The tee 306 may take the form of a telescoping tee with multiple segments that nest within each other. In the illustrated embodiment, the tee 306 includes a base tee segment 330, an intermediate tee segment 332, and a top tee segment 334. A cup 336 to hold a ball is removably receivable into the top tee segment 334.

Figure 16:
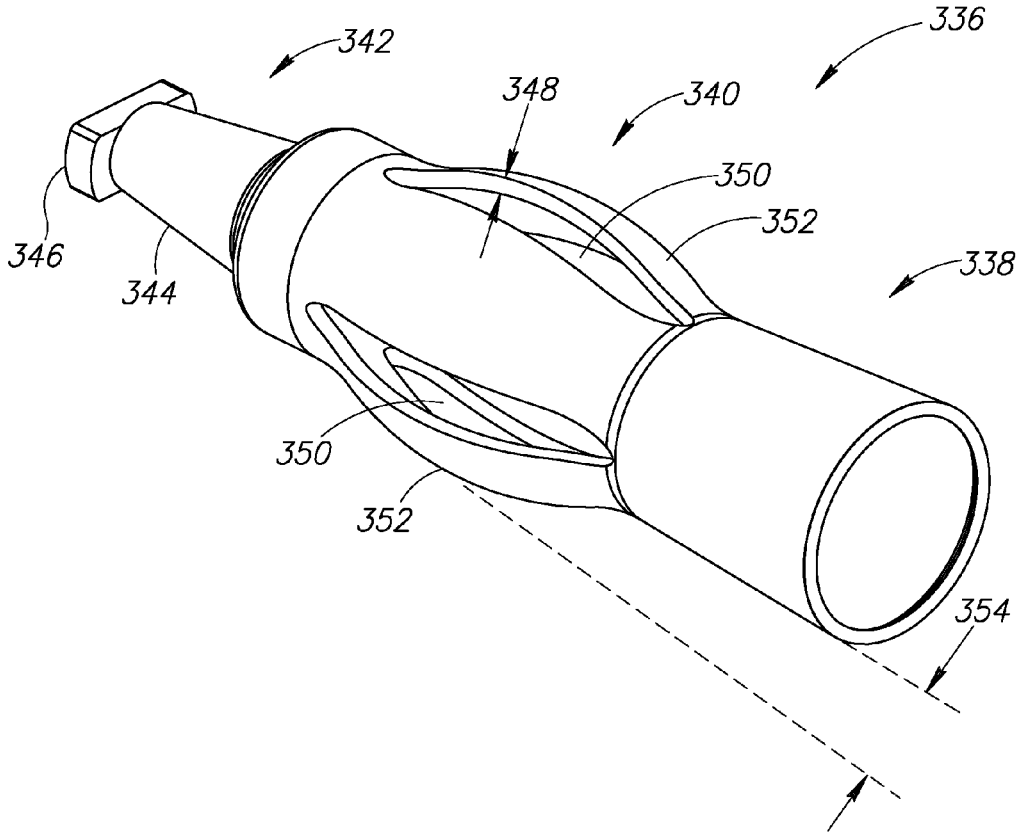
FIG. 16 is a perspective view of a flexible cup for a batting tee according to an embodiment of the present invention.

FIG. 16 shows the cup 336 having a ball support portion 338, a flexible portion 340, and an engagement portion 342. In one embodiment, the ball support portion 338 takes the form of a continuous walled cylinder or cone, optionally with a thicker walled region near its top, and may be produced in different diameter shapes depending on the type of ball being hit (e.g., a baseball versus a softball). The engagement portion 340 may take the form of a tapered member 344 with a cross member 346 that is received into the top tee segment 334. The cross member 346 is an optional component because the tapered member 344 may be configured to provide a friction, interference fit with the top tee segment 334, thus negating the need for the cross member 346. In the illustrated embodiment, the cross member 346 takes the form of a T-shaped cross member 346 that permits the cup 336 to be keyed or locked with respect to the tee 306, which in turn makes it remain more stable during repeated use. The cross member 346 may have other configurations besides T-shaped as long as it preferably locks into the tee 304.

The flexible portion 340 is configured to be bendable, durable, and replaceable. In one embodiment, a mid, cross-sectional bending stiffness of the flexible portion 340 is less than a mid, cross-sectional bending stiffness of the ball support portion 338. Regardless of the bending stiffness, the flexible portion 340 is predisposed to bend before the ball support portion when a ball is hit off of the batting tee. The resiliency of the flexible portion 340 and hence its predisposition to bending before the ball support portion 338 may be achieved through one or more structural configurations, such as controlling a wall thickness 348, controlling the material properties, selectively arranging slots or apertures 350 between strips or webs 352, by providing a bulged-out or arcuate shape 354 relative to the ball support portion 338, or some combination thereof. One of these configurations or any combination of them may adequately support the ball while permitting the cup 336 to flex such that the batter barely notices, or may not even notice, any bounce back or resistance from the batting tee. In conventional batting tee systems, the cup typically made from a resilient rubber that is generally cone shaped or cylindrically shaped, and includes a stiffness that provides an undesired bounce back or recoil when a ball is hit off the tee. In contrast and in accordance with an embodiment of the present invention, the predisposed ability of the flexible portion 340 to easily bend eliminates or substantially eliminates any such bounce back or sensed swing feedback.

Figure 17:
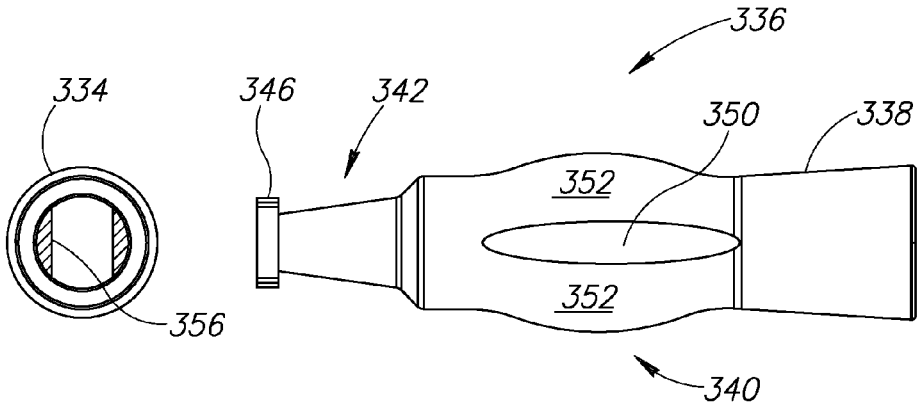
FIG. 17 is a side elevational view of the cup of FIG. 16 along with a top plan view of a receiving portion of the batting tee of FIG. 15 according to an embodiment of the present invention.

FIG. 17 shows the cup 336 with the cross member 346 configured to engage a complementary receiving portion 356 of the top tee segment 334. The receiving portion 356 may take the form of a shoulder or ledge that permits the cross member 346 to clear when rotated in one direction, but then retains the cross member 346 when the cup 336 is rotated by a desired angle, for example about ninety degrees, but appreciating that only a slight amount of rotation may be sufficient to retain the cup 336 relative to the tee segment 334.

Figure 18:
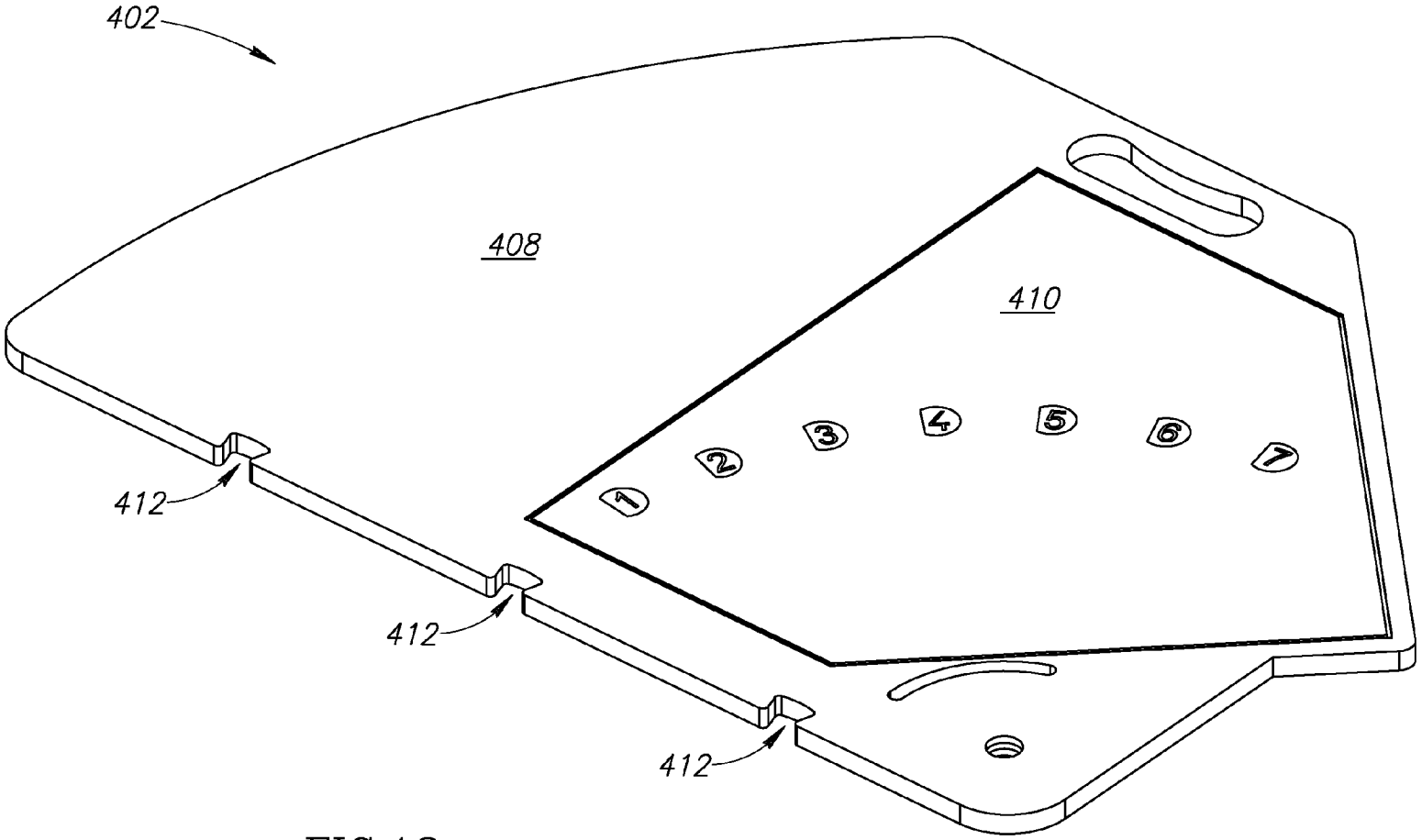
FIG. 18 is a perspective view of a support base with a home plate according to an embodiment of the present invention.

FIG. 18 shows a platform 402 having an extended support portion 408 and a home plate 410 recessed into the support portion 408. The extended support portion 408 may allow for additional adjustments depending on a variety of factors such as, but not limited to a height of the batter, swinging style, distance to pitching mound, etc. In addition, the platform 402 includes engagement regions 412, which may take the form of notches or protruding tabs. The engagement regions 412 are configured to engage with the stance guide 314 (FIG. 15).

Figure 19:
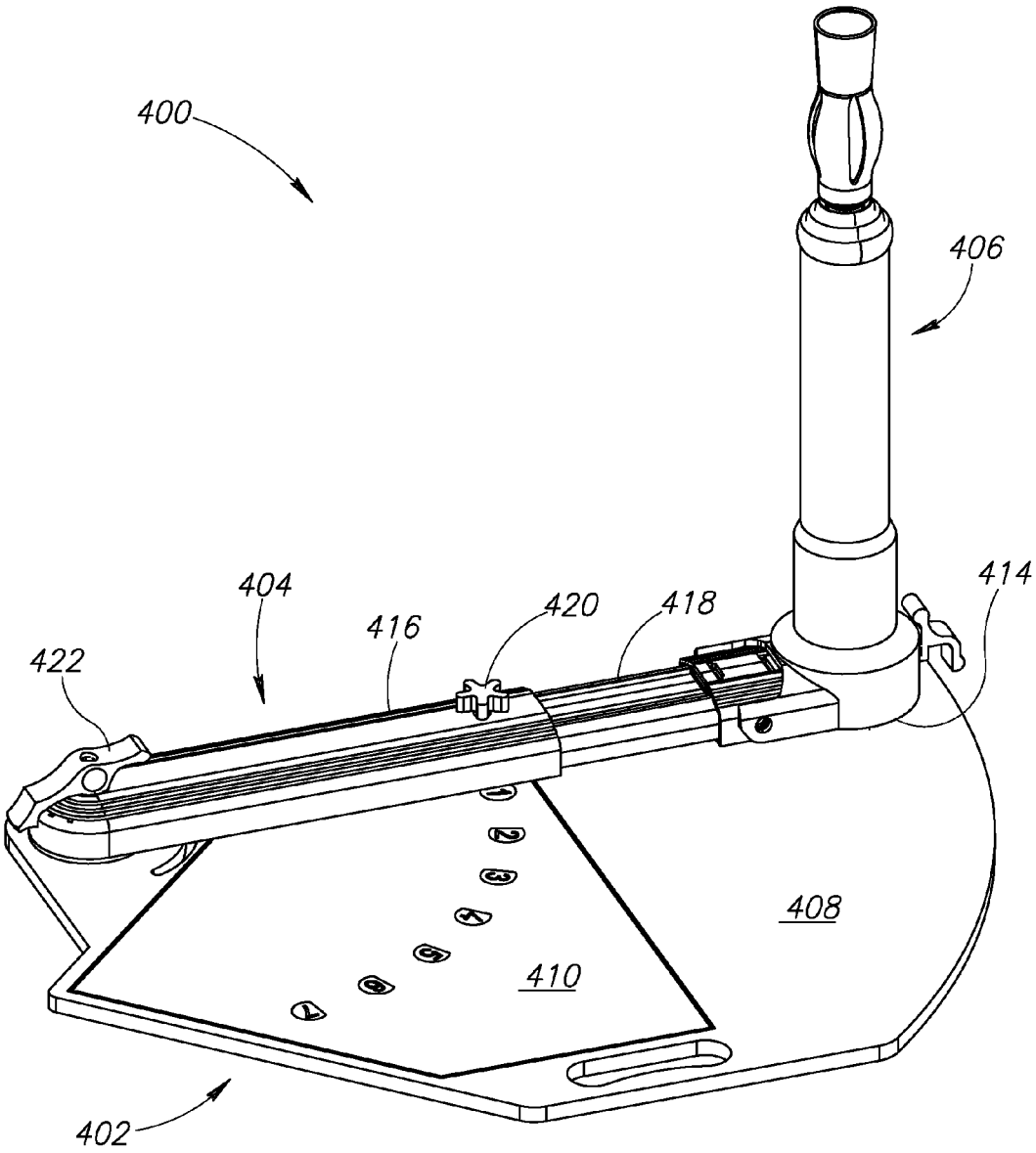
FIG. 19 is a perspective view of a batting tee system with an extendable swing arm according to an embodiment of the present invention.

FIG. 19 shows a batting tee system 400 according to another embodiment of the present invention. The batting tee system 400 includes the platform 402, a swing arm 404, and a batting tee 406. The platform 402 includes the extend support portion 408 and plate 410. The swing arm 404 includes three segments as shown in the illustrated embodiment. By way of example, the swing arm 404 includes a batting tee support segment 414, a plate segment 416 that rotates substantially over the plate 410, and an extension segment 418 that permits the batting tee support segment 414 to be slid or otherwise adjusted relative to the plate segment 416. Once the batting support segment 414 is in a desired location relative to the platform 402 then it may be secured with knob 420 according to an embodiment of the present invention. Optionally, the plate segment 414 may be locked or secured to the platform 402 using a lever 422 instead of the knob 318 of FIG. 15.

Figure 20:
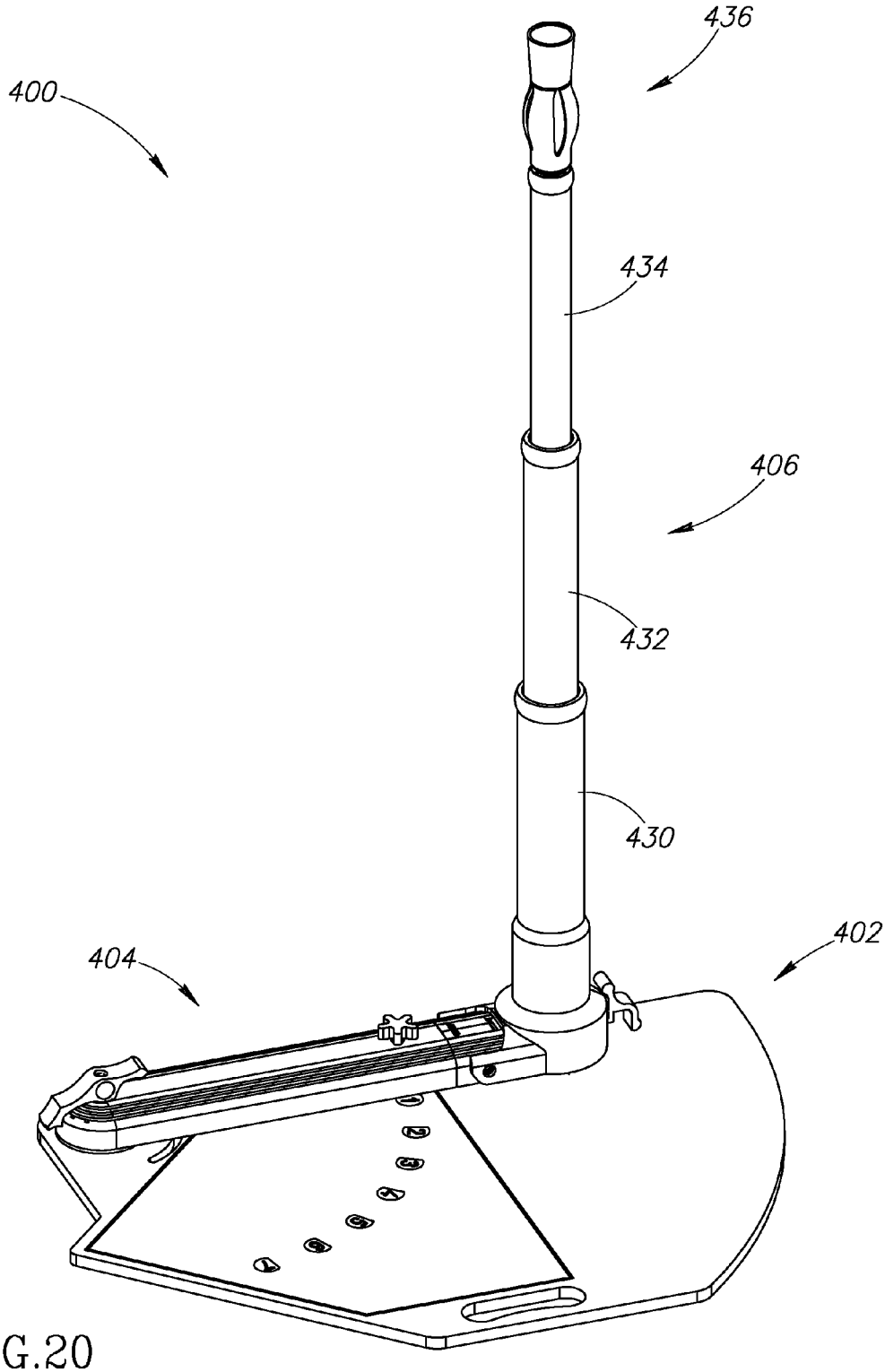
FIG. 20 is a perspective view of the batting tee system of FIG. 19 with telescoping segments of the batting tee fully extended according to an embodiment of the present invention.
Figure 21:
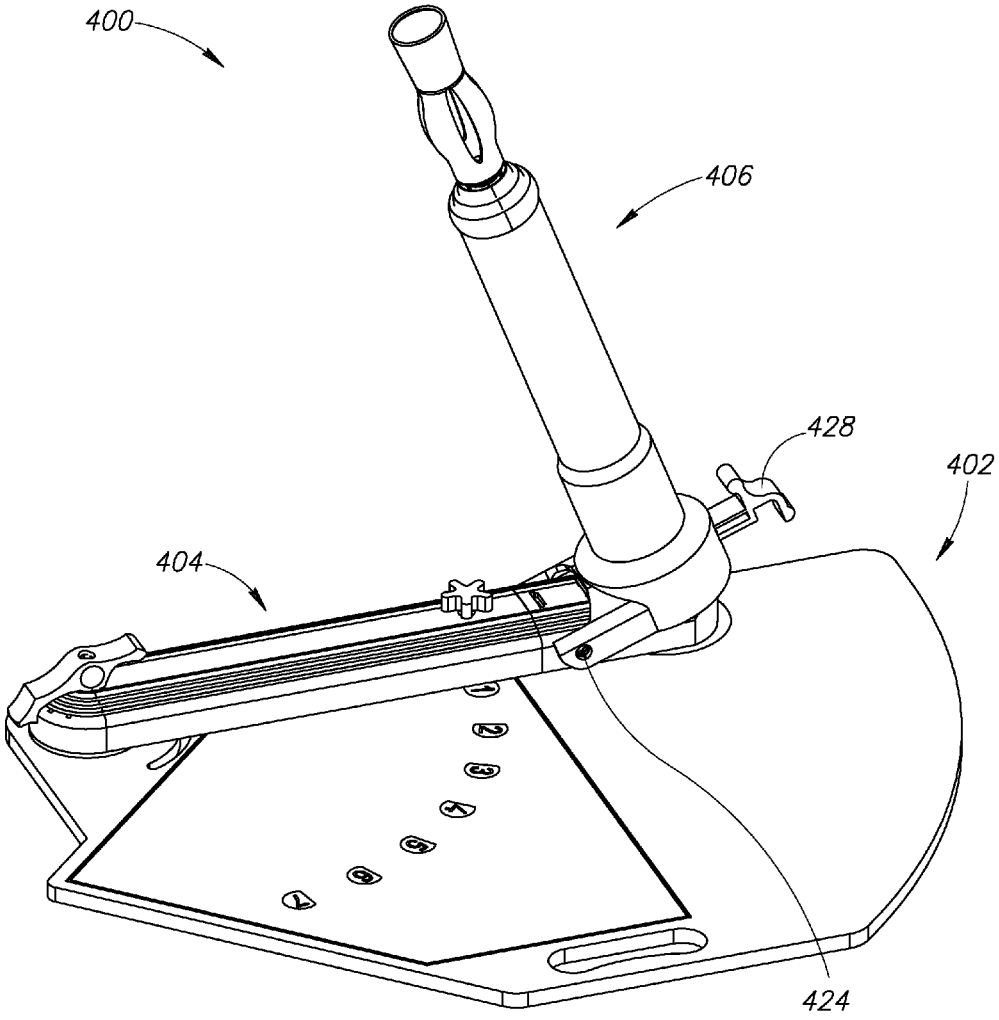
FIG. 21 is a perspective view of the batting tee system of FIG. 19 with the batting tee being rotated relative to the swing arm according to an embodiment of the present invention.
Figure 22:
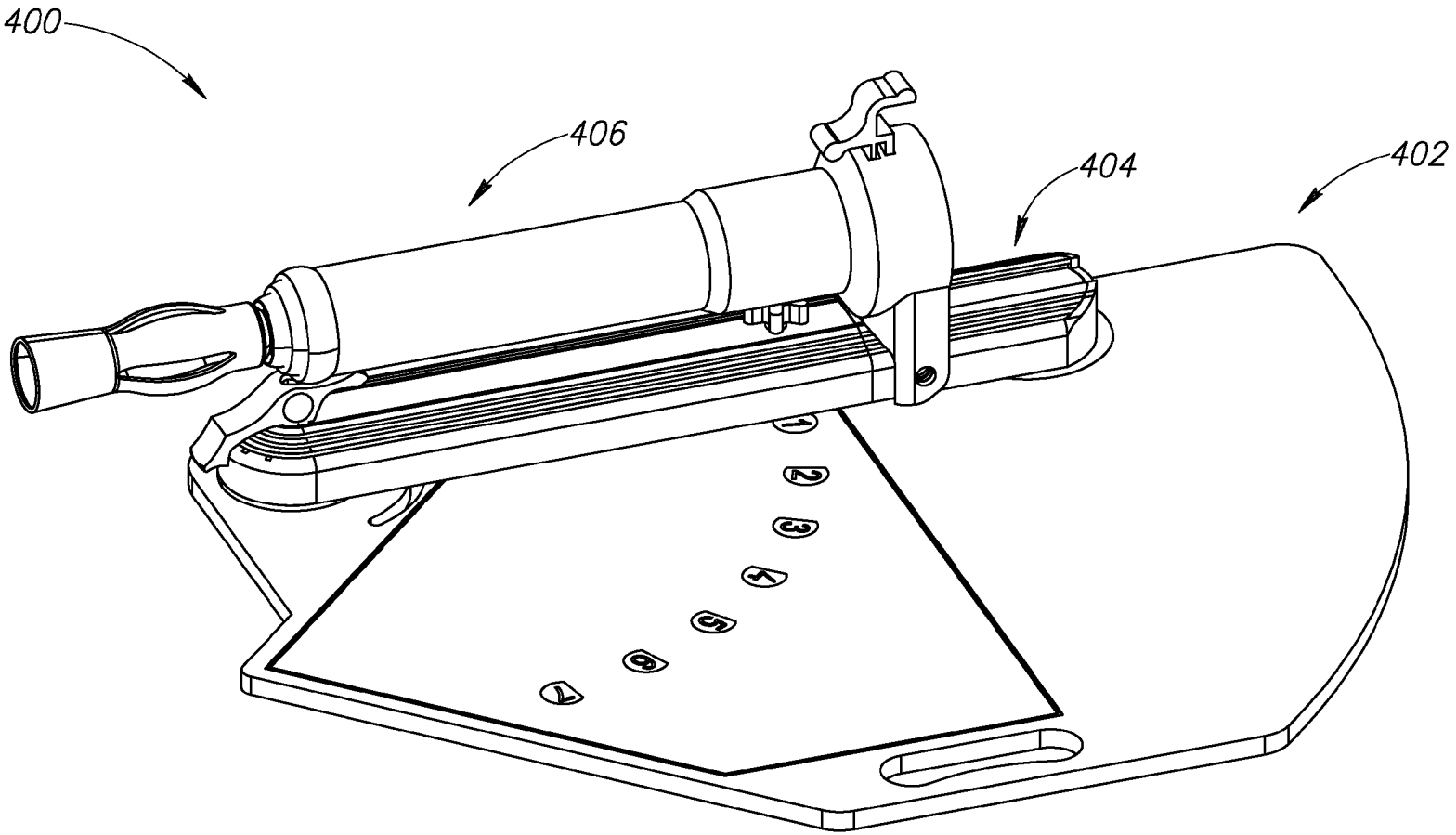
FIG. 22 is a perspective view of the batting tee system of FIG. 19 with the batting tee in a stored position relative to the swing arm according to an embodiment of the present invention.

FIG. 20 shows the batting tee system 400 of FIG. 19 with telescoping segments 430, 432, 434 of the batting tee 406 fully extended. FIG. 20 shows the batting tee system of FIG. 19 with the batting tee 406 being rotated relative to the swing arm 404. In the illustrated embodiment, a locking clip 428 has been pulled to permit rotation of the batting tee 406 about a hinge 424. FIG. 22 shows the batting tee 406 in a stored configuration with respect to the swing arm 404 and the platform 402.

Figure 23:
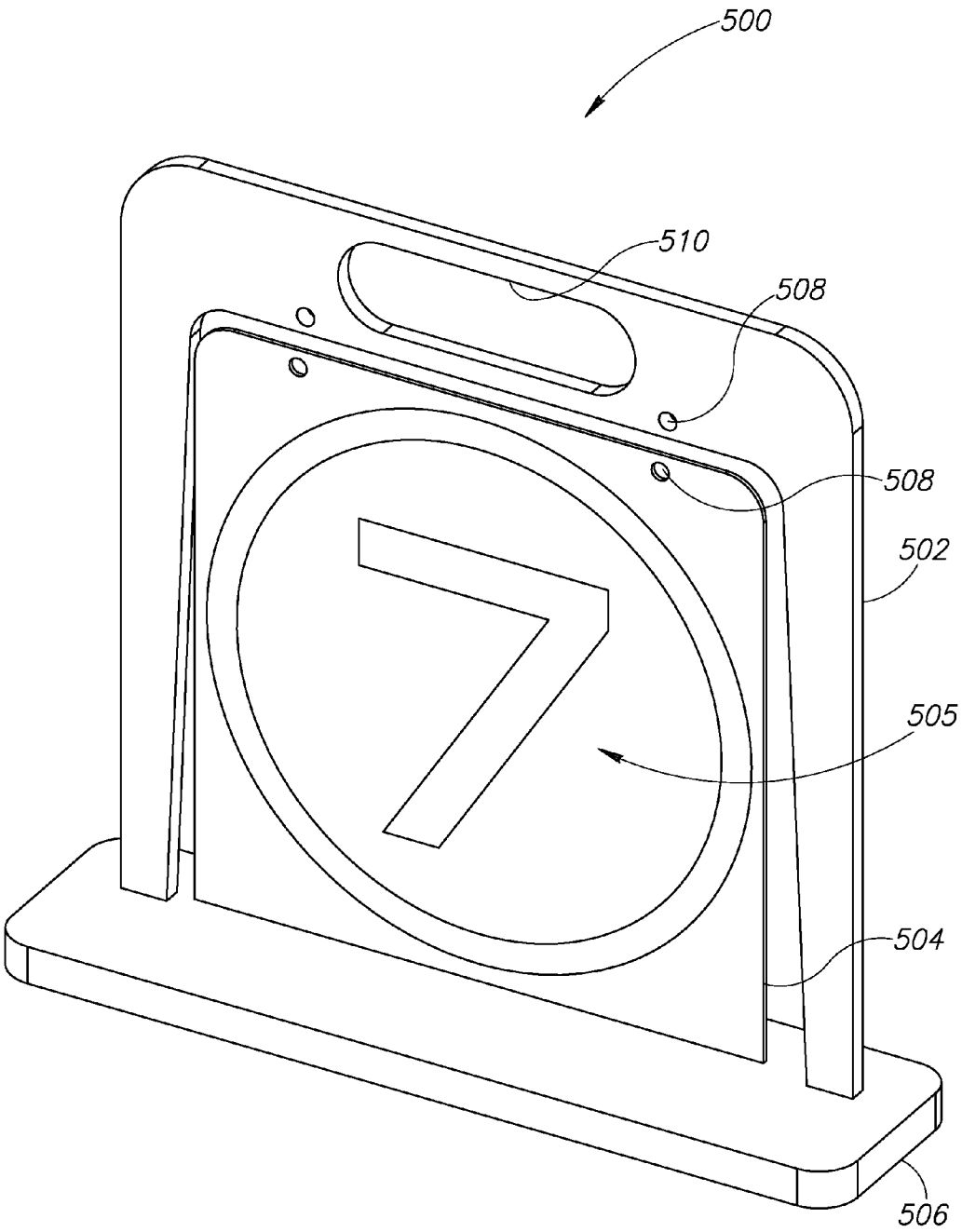
FIG. 23 is a target for a batting tee system according to an embodiment of the present invention.

FIG. 23 shows a target 500 that may be placed a desired distance from the batter. In the illustrated embodiment, the target 500 includes a frame 502, a contact indicator 504, and a support base 506. The indicator 504 may take the form of a swingable or rotatable plate bearing indicia 505, which may take the form of an alphanumeric character or some other graphic or symbol, which preferably corresponds to characters or symbols carried by the platform 402 (FIG. 22). The indicator 504 may be clipped, tied, or otherwise coupled to the frame 502 via openings 508 that permit rotation of the indicator upon contact by a ball. Optionally, the target 500 may include a carrying handle 510, which may take the form of an opening in a top portion of the frame 502.

Hitting the ball effectively is an important skill in any bat-and-ball type game. Often times, teams are formed around the so-called good hitters. The batting tee systems described herein provide a cost effective way for a batter to improve his or her hitting mechanics. In addition, the batting tee system may be assembled and set-up such that even persons who have never played a bat-and-ball sport may assist a young batter with the proper mechanics.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined by reference to the claims that follow.

The embodiments of the invention in which an exclusive property or privilege is claimed are defined as follows:

1. A cup for a batting tee system, the cup comprising:

a ball support portion;

an engagement portion receivable by a tubular member of the batting tee system; and a flexible portion located between the ball support portion and the engagement portion, wherein the flexible portion is predisposed to bend before the ball support portion bends when a ball is hit off the batting tee;

wherein the flexible portion includes a plurality of strips circumferentially arranged, and wherein at least two strips are circumferentially spaced apart by a slot.

2. The cup of claim 1, wherein the ball support portion is a generally cylindrical, continuous tube.

3. The cup of claim 1, wherein the slots of the flexible portion are arranged approximately vertically.

4. The cup of claim 1, wherein the ball support portion is made from a first material and the flexible portion is made from a second material that is different from the first material.

5. The cup of claim 1, wherein the engagement portion includes a tapered body.

6. The cup of claim 1, wherein the engagement portion includes a T-shaped cross member configured to selectively engage the tubular member of the batting tee system.

7. The cup of claim 1, wherein the flexible portion includes a mid region that bulges outward relative to an outer diameter of the ball support portion.

8. The cup of claim 1, wherein an outer diameter of the mid region of the flexible portion exceeds an outer diameter of the ball support portion.

9. A batting tee assembly comprising:

a base portion configured with a home base;

a swing arm adjustably coupled to the base, the swing arm extending laterally over and proximate to an upper surface of the base, the swing arm selectively positionable along an arc relative to the home base;

an adjustable-height batting tee coupled to the swing arm, the tee movable with the swing arm to be positioned in a location along the arc corresponding to a type of pitch being simulated; and a cup having a ball support portion, an engagement portion, and a flexible portion, the engagement portion removably engageable with the batting tee, the flexible portion located between the ball support portion and the engagement portion, the flexible portion predisposed to bend before the ball support portion bends when a ball is hit off the batting tee, wherein the flexible portion includes a plurality of strips circumferentially arranged, and wherein at least two strips are circumferentially spaced apart by a slot.

10. The batting tee assembly of claim 9, wherein the swing arm is an extendable swing arm.

11. The batting tee assembly of claim 10, wherein the base portion is complementarily extended to accommodate the arc of the extended swing arm.

12. The batting tee assembly of claim 9, wherein the base portion includes engagement portions to receive a stance guide.

13. The batting tee assembly of claim 12, wherein the stance guide is removably attachable to the engagement portion of the base portion, and wherein the stance guide carries visible indicia to indicate a batter's position relative to the home base.

14. The batting tee assembly of claim 9, wherein the batting tee is hingedly coupled to the swing arm.

15. The batting tee assembly of claim 9, wherein the batting tee includes telescoping tubular members nested within one another.

16. The batting tee assembly of claim 9, further comprising a target positionable to be hit by a ball when the ball is struck at a desired point, the target having a plate rotationally coupled to a support frame such that contact of the plate with the ball causes the plate to rotate relative to the support frame.

17. A method of setting up a batting tee system, the method comprising:

arranging a home base for a left or right handed batter, the home base coupled to a base portion of the batting tee system;

coupling a first end portion of a swing arm to the base portion;

rotating a second end portion of the swing arm about a pivot located relative to the home base, the second end portion distally located from the first end portion;

setting an adjustable-height batting tee at a desired position along a contact path to simulate a desired pitch; and attaching a flexible cup to the batting tee by inserting a portion of the cup and rotating it relative to the tee such as to lock the cup relative to the tee, the flexible cup includes a flexible portion that is predisposed to bend before an adjacent ball support portion bends when a ball is hit off the batting tee;

wherein the flexible portion includes a plurality of strips circumferentially arranged, and wherein at least two strips are circumferentially spaced apart by a slot.

18. The method of claim 17, further comprising replacing the flexible cup with a different flexible cup configured to hold a different sized ball.

19. The method of claim 17, further comprising attaching a stance guide to the base portion of the batting tee system.

20. The batting tee assembly of claim 9, wherein the flexible portion includes a mid region that bulges outward relative to an outer diameter of the ball support portion.

21. The batting tee assembly of claim 9, wherein the flexible portion includes a mid region having a maximum outer diameter that exceeds a maximum outer diameter of the ball support portion.

22. The batting tee assembly of claim 9, wherein the flexible portion includes a T-shaped cross member that permits the cup to be removably and replaceably secured to the batting tee.

* * * * *